US010717172B2

(12) United States Patent
Kosik, Sr. et al.

(10) Patent No.: US 10,717,172 B2
(45) Date of Patent: Jul. 21, 2020

(54) UNIVERSAL SINGLE PERSON UNDERMOUNT FIXTURE INSTALLATION DEVICE AND METHOD OF USING SAME

(71) Applicants: Thomas Kosik, Sr., Pelham, NH (US); Dario Correia, Georgetown, MA (US); Norman Fine, Charlestown, MA (US)

(72) Inventors: Thomas Kosik, Sr., Pelham, NH (US); Dario Correia, Georgetown, MA (US); Norman Fine, Charlestown, MA (US)

( * ) Notice: Subject to any disclaimer, the term of this patent is extended or adjusted under 35 U.S.C. 154(b) by 0 days.

(21) Appl. No.: 16/214,089

(22) Filed: Dec. 9, 2018

(65) Prior Publication Data

US 2020/0180120 A1 Jun. 11, 2020

(51) Int. Cl.

| | |
|---|---|
| ***B25B 9/02*** | (2006.01) |
| ***B25B 11/02*** | (2006.01) |
| ***E03C 1/33*** | (2006.01) |

(52) U.S. Cl.

CPC ..... *B25B 11/02* (2013.01); *E03C 1/33* (2013.01)

(58) Field of Classification Search

CPC .... B25B 1/00; B25B 1/10; B25B 1/20; B25B 1/2494; B25B 3/00; B25B 5/00; B25B 9/00

See application file for complete search history.

(56) References Cited

U.S. PATENT DOCUMENTS

| | | | | | |
|---|---|---|---|---|---|
| 4,893,801 | A * | 1/1990 | Flinn | B25B 5/06 | 269/214 |
| 5,460,461 | A * | 10/1995 | McGrath | B05C 17/10 | 269/45 |
| 6,155,547 | A * | 12/2000 | Gatanas | B25B 5/12 | 269/41 |
| 7,628,434 | B2 * | 12/2009 | Bruce | B65G 49/061 | 294/65 |
| 2011/0089621 | A1 * | 4/2011 | Seidel | B25B 5/102 | 269/46 |
| 2013/0341847 | A1 * | 12/2013 | Bense | B64F 5/10 | 269/21 |

* cited by examiner

*Primary Examiner* — Lee D Wilson

(57) ABSTRACT

A Universal Single Person Undermount Fixture Installation Device is sued for the installation of undermount style plumbing fixtures by a single installer. This device includes a support that is set atop the counter/substrate and spans the opening where the fixture is to be raised into its final position. This support includes an attachment that protrudes down through the opening and engages the fixture through the drain opening to allow it to be raised from above the countertop. This device also includes a method for final tightening of the fixture from above while in full view of its current alignment to the opening within the counter/substrate. The tool can be disengaged to release from the fixture drain opening once the fixture is fastened in accordance with the manufacturer's instructions.

8 Claims, 14 Drawing Sheets

UNIVERSAL SINGLE PERSON UNDERMOUNT FIXTURE INSTALLATION DEVICE AND METHOD OF USING SAME

FIELD OF THE INVENTION

The present invention relates to the plumbing industry. More particular, the invention relates to the placement and installation of undermount "fixtures" such as lavatories and kitchen sinks to the underside of countertops, in preparation for final securing.

The inventors of this device represent different facets of the commercial plumbing industry. Thomas Kosik has been a union plumber and project manager for over 35 years and has seen firsthand the need for this type of device to assist with the installation of plumbing fixtures. Norman has over 30 years in the industry as a commercial salesman for one of the largest plumbing vendors in the country. He has sold countless undermount fixtures and devices but has never sold or seen a device to assist with the installation of undermount fixtures. Dario Correia has an engineering and project management background and is constantly working on implementing and improving installation technology, devices and methods to combat the compressed schedules the industry is now facing. Together, this team is confident that the product we are presented herein is an industry necessity, is unique, marketable on a large scale and of sound engineering design and capability.

BACKGROUND OF THE INVENTION

Installing undermount fixtures is typically a two-person activity. Once the countertop hole [1] is developed, the fixture [3] is ready for installation. Installer 1 will reach through the opening and grasp the fixture [3], raising it into place against the underside of the substrate [2] for attaching. While Installer 1 maintains the position of the fixture, Installer 2 will gain access to the cabinet [4] or opening underneath the fixture and substrate for final fastening. This current state of this installation is labor intense, cumbersome, inefficient and crowded with 2 installers in a very tight area.

Certain installers have suggested the use of a brace or bracket to support the fixture once it is raised into place against the underside of the countertop. This method allows for installation with 1 installer but has considerable draw backs. The use of a support from the underside of the fixture [3] prevents access to make final necessary connections underneath the fixture [3] and often time delays the installation process. The conditions below an undermount fixture vary based on the installation environment and this method is not a universal solution such as the one we have invented. Another drawback is that when using a single installer with support from below, the alignment of the fixture within the opening cannot be verified from above as it is secured into place. This increases the margin of error for proper alignment of the fixture and may increase installation time if the process needs to be repeated. Therefore, a need exists in the field of plumbing/construction installations for a universal single person undermount fixture installation device.

BRIEF SUMMARY OF THE INVENTION

Using this undermount fixture installation device provides universal installation capability for a single person. The device is placed over the countertop/substrate opening and the fixture is placed below the opening in the cabinet's base.

The device includes a shaft [5] which is lowered through the counter opening [1], into and through the fixture drain opening [6]. A device on the end of the shaft then engages and supports the underside of the fixture through the drain opening to allow for the raising and lowering of the fixture with ease. The ergonomic design and operating features can raise the fixture to the underside of the substrate, assure proper alignment on the first try and secure the fixture in a hands-free state without any additional personnel, braces or brackets supporting the fixture from below when completing the installation.

DETAILED DESCRIPTION OF THE INVENTION

Figure 8:
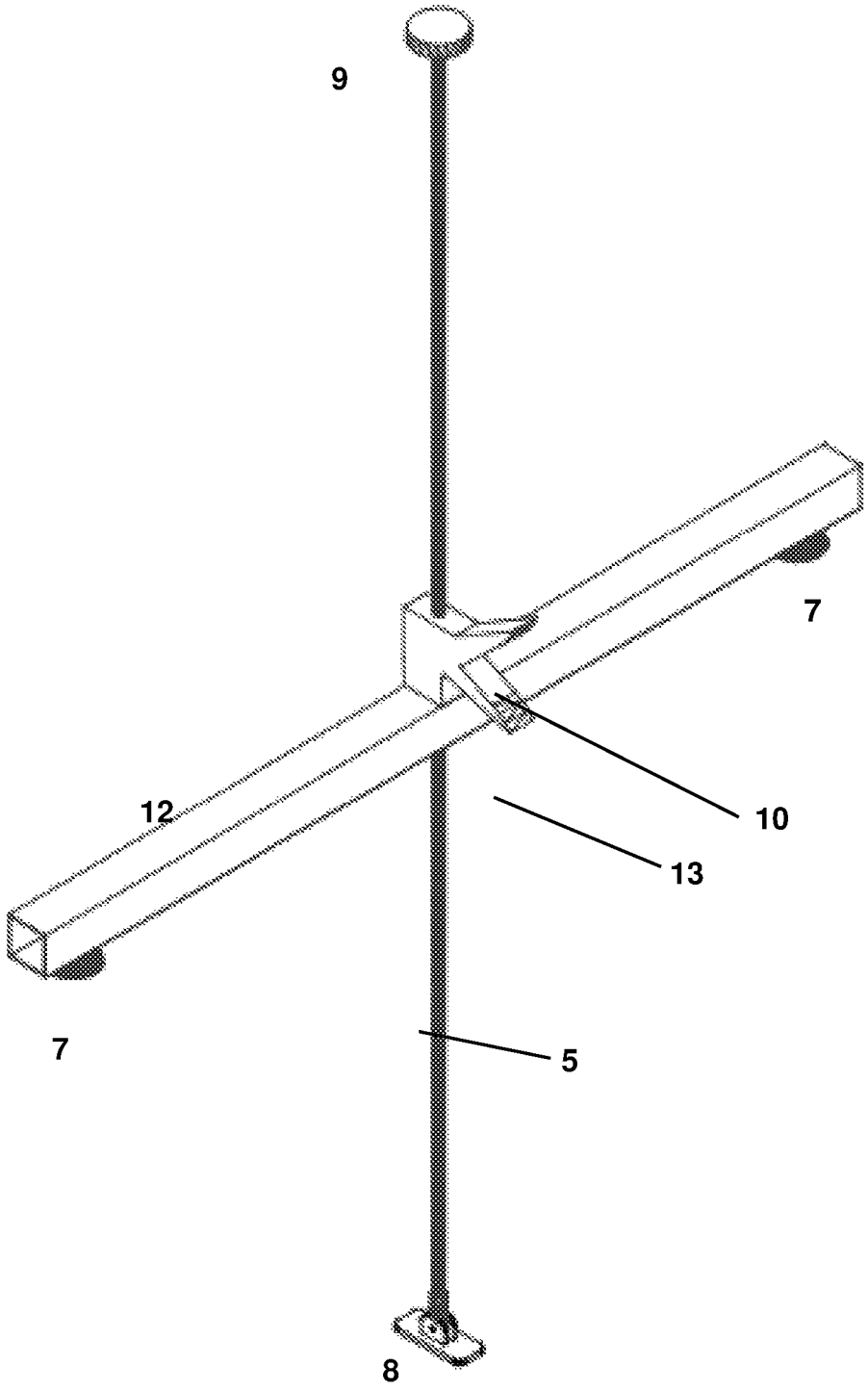
FIG. 8—Depicts the conceptual design of the device described herein in isometric view.
Figure 9:
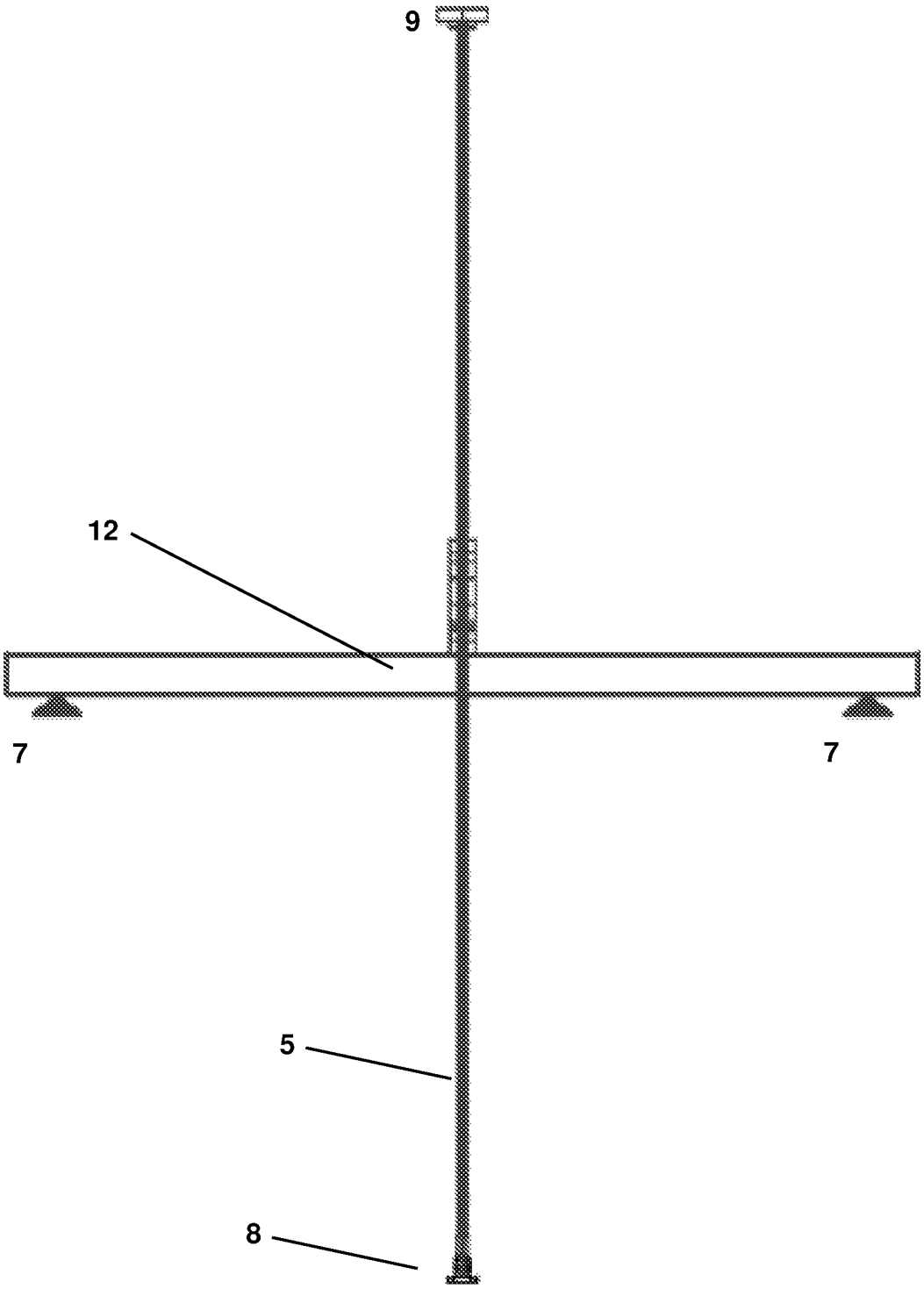
FIG. 9—Depicts the conceptual design of the device described herein in front wireframe view.
Figure 10:
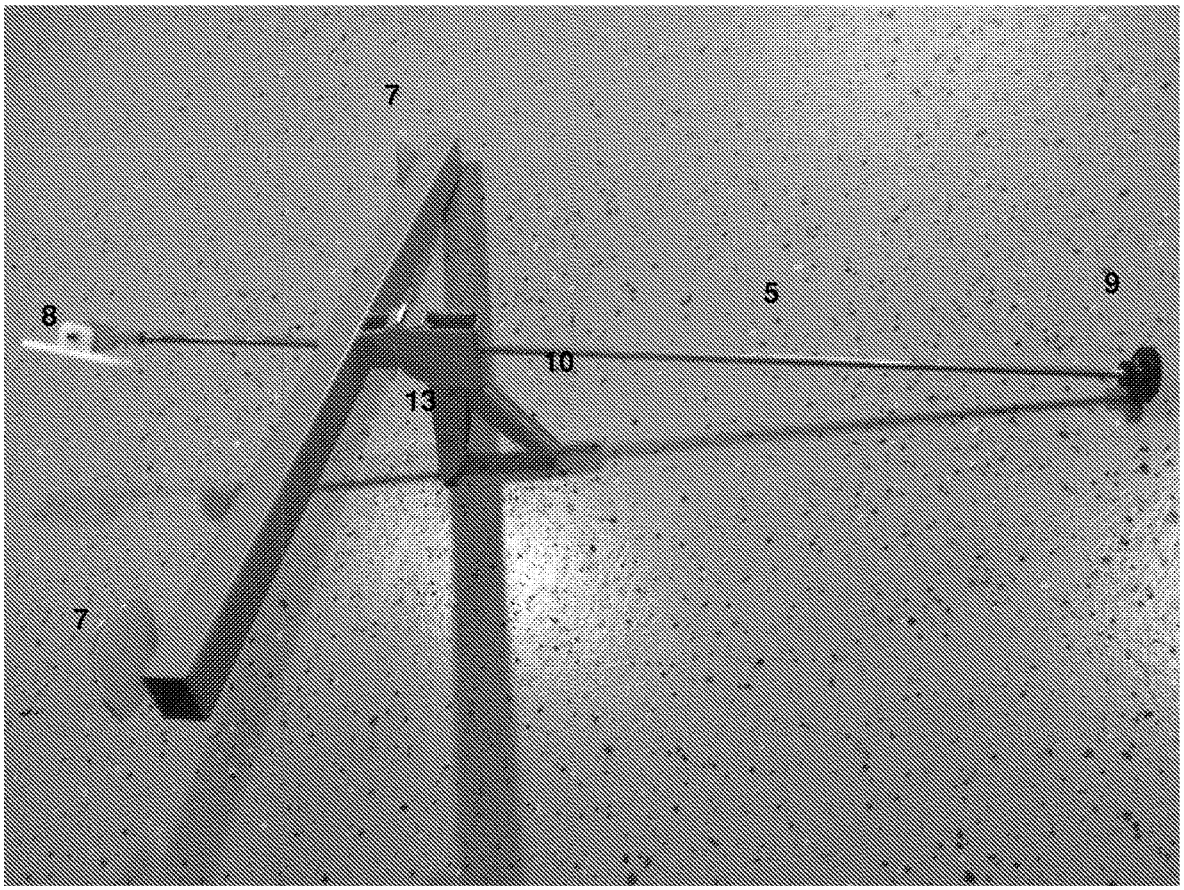
FIG. 10—Depicts an image of working prototype device described herein.
Figure 11:
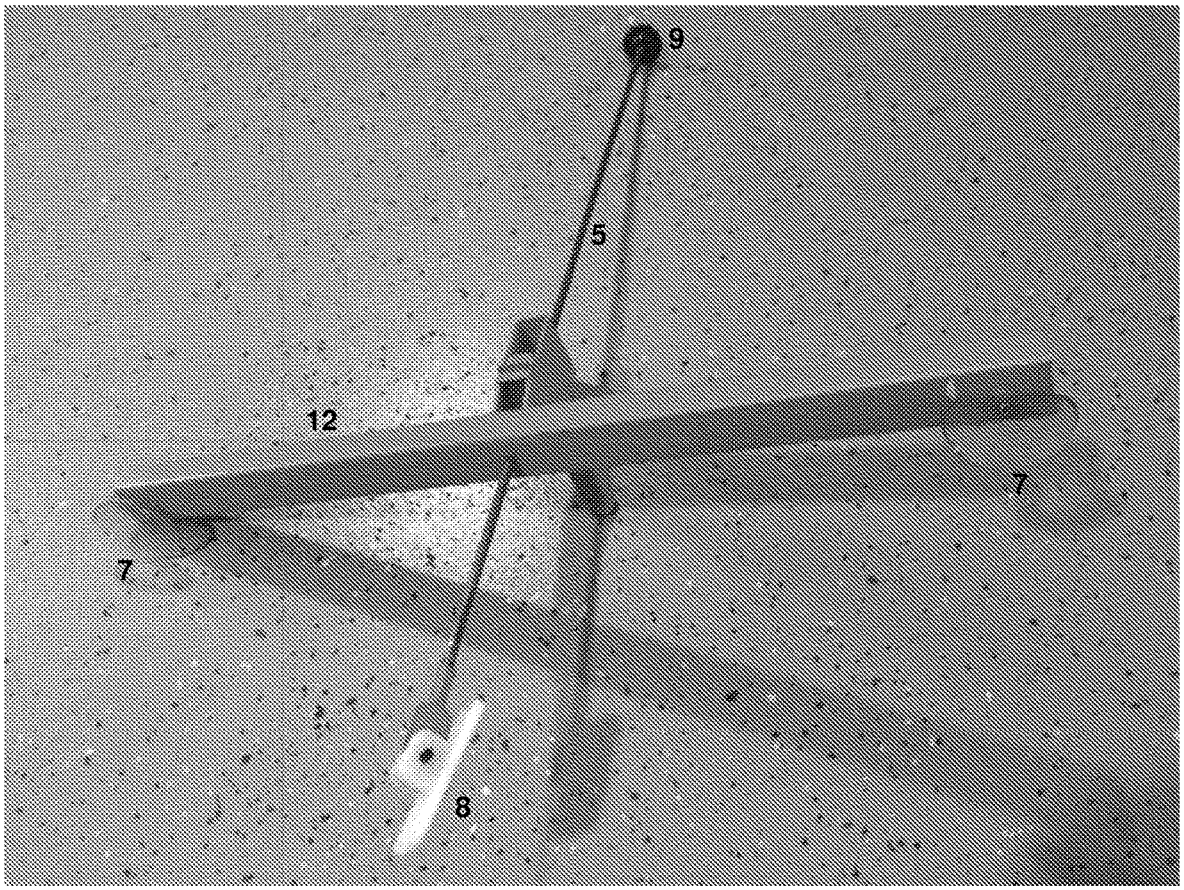
FIG. 11—Depicts an additional image of the working prototype device described herein.

The single person undermount fixture device, FIG. 8 according to the present invention, is used to install a fixture [3] or similar appurtenance designed for undermount attachment to a substrate [2]. Once a countertop hole [1] is developed in the substrate [2], the undermount fixture [3] may be placed in the base of the cabinet [4]. The appropriate installation sealant and clips may then be applied in accordance with manufacturers recommendations to the bottom of substrate [2] and or top of the fixture [3].

Figure 1:
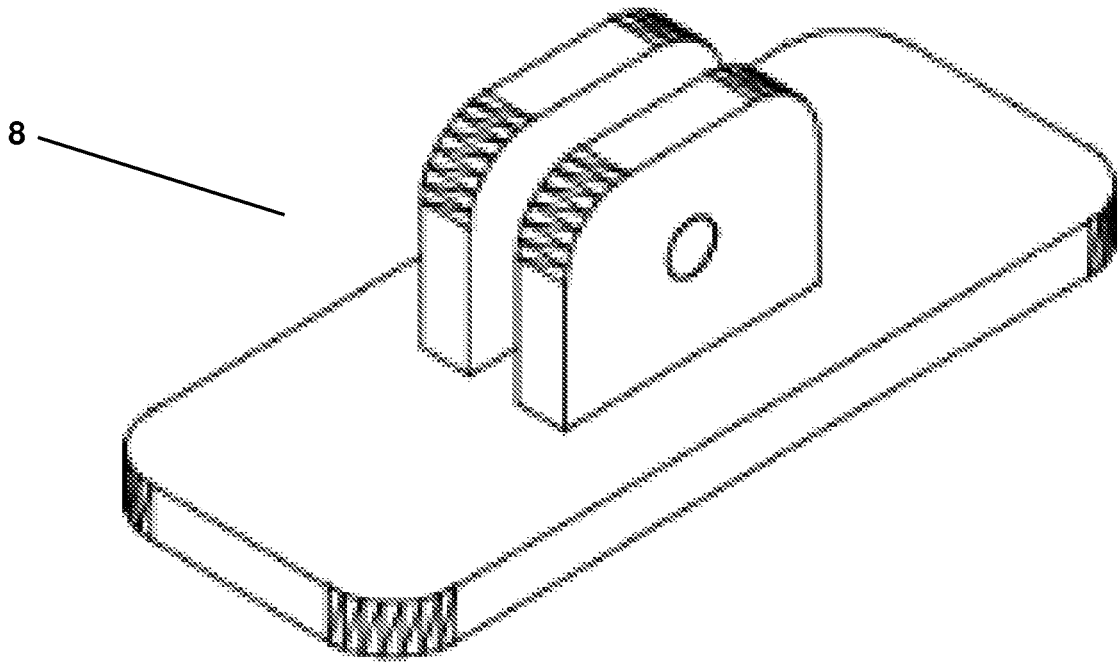
FIG. 1—Depicts the conceptual design of the sized support which attaches to the shaft end for various fixture types and drain sizes.
Figure 2:
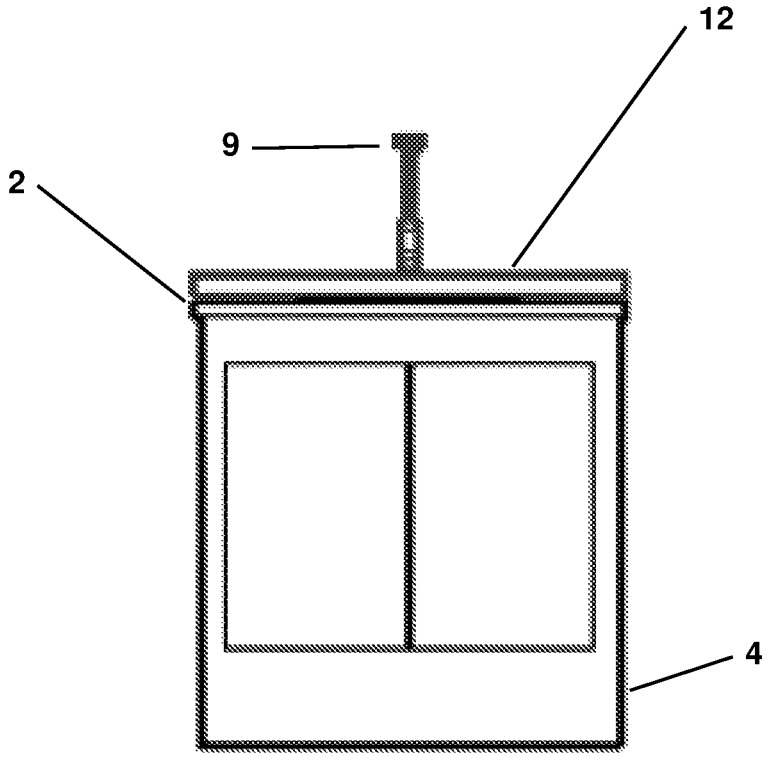
FIG. 2—Depicts the conceptual design front view of the universal single person undermount fixture installation device and method in its initial state on top of the substrate and connected to the fixture.
Figure 3:
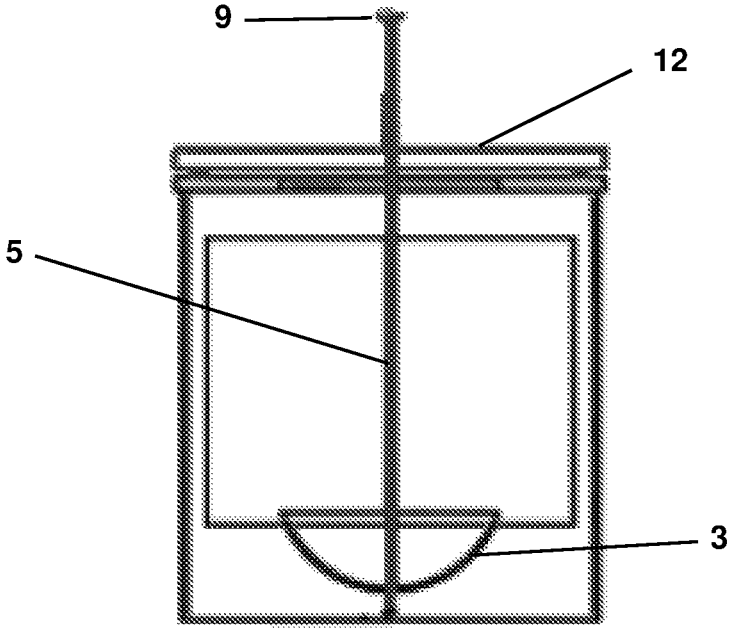
FIG. 3—Depicts the conceptual transparent front view of the universal single person undermount fixture installation device and method in its initial state on top of the substrate and connected to the fixture.
Figure 4:
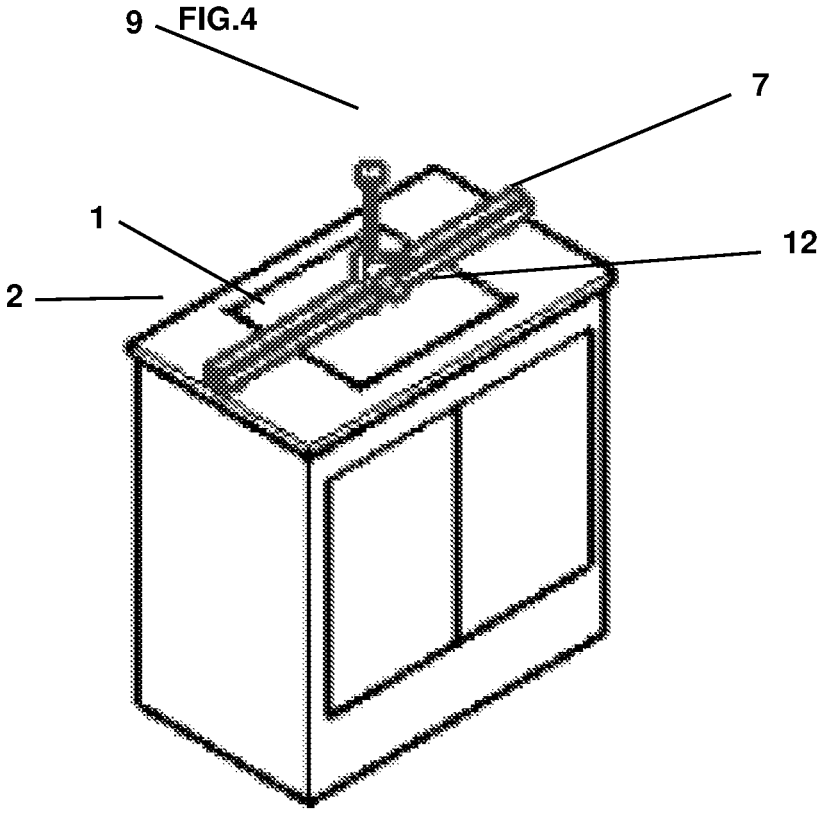
FIG. 4—Depicts the conceptual design isometric view of the universal single person undermount fixture installation device and method in its working state on top of the substrate and connected to the fixture.
Figure 5:
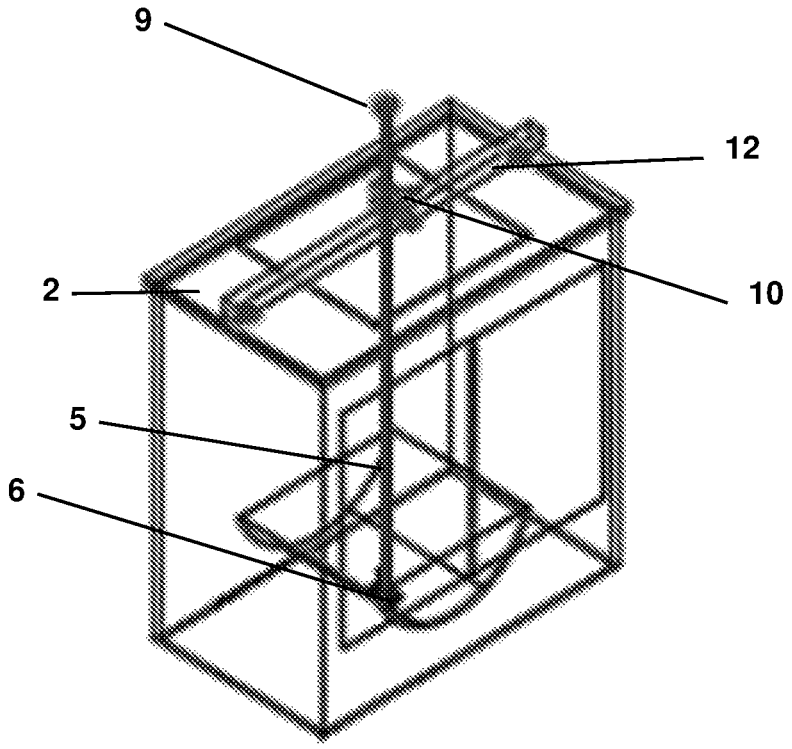
FIG. 5—Depicts the conceptual transparent isometric view of the universal single person undermount fixture installation device and method in its working state on top of the substrate and connected to the fixture.
Figure 6:
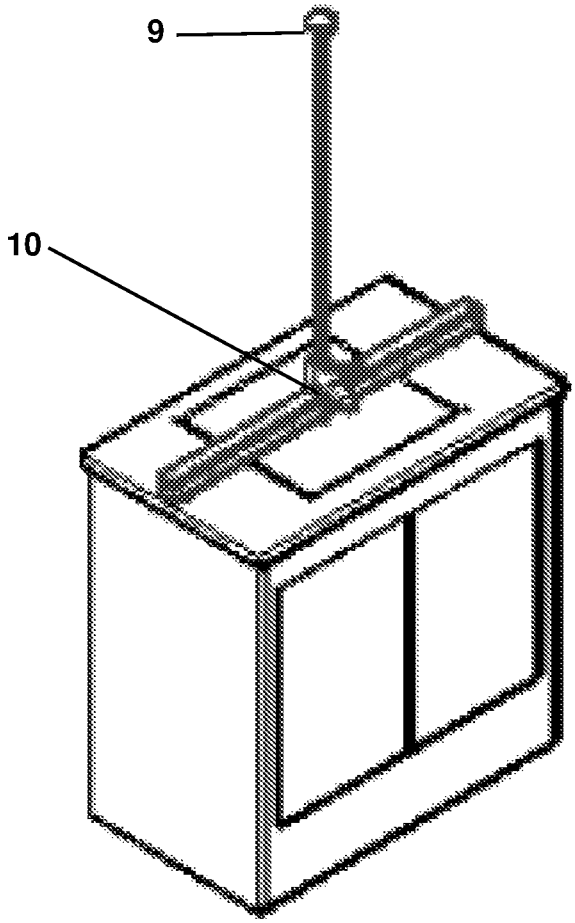
FIG. 6—Depicts the conceptual design isometric view of the universal single person undermount fixture installation device and method in its final state on top of the substrate with the fixture fully installed.
Figure 7:
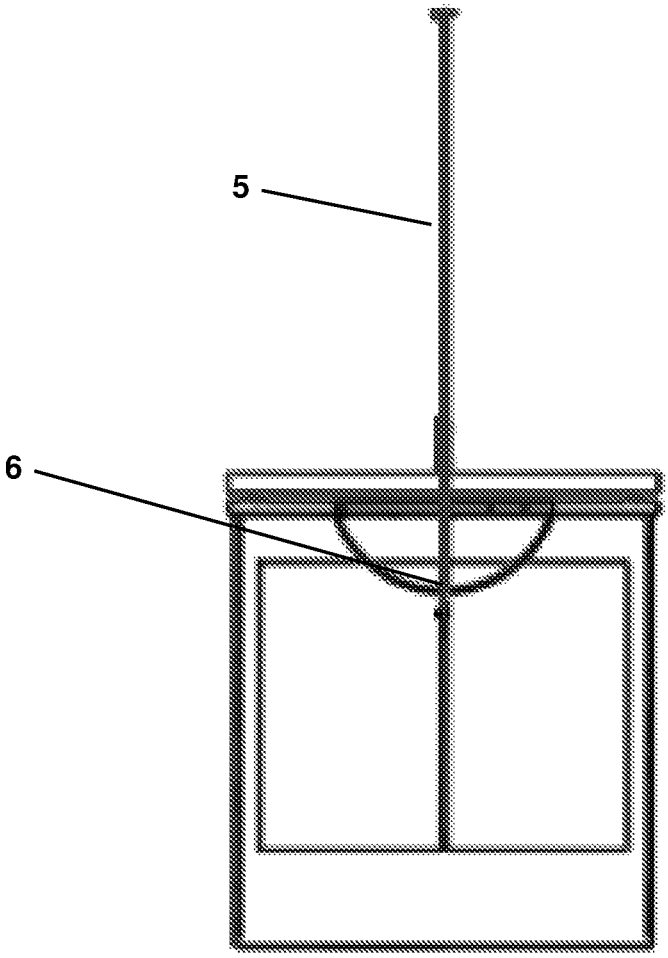
FIG. 7—Depicts the conceptual transparent front view of the universal single person undermount fixture installation device and method in its final state on top of the substrate with the fixture fully installed.
Figure 12:
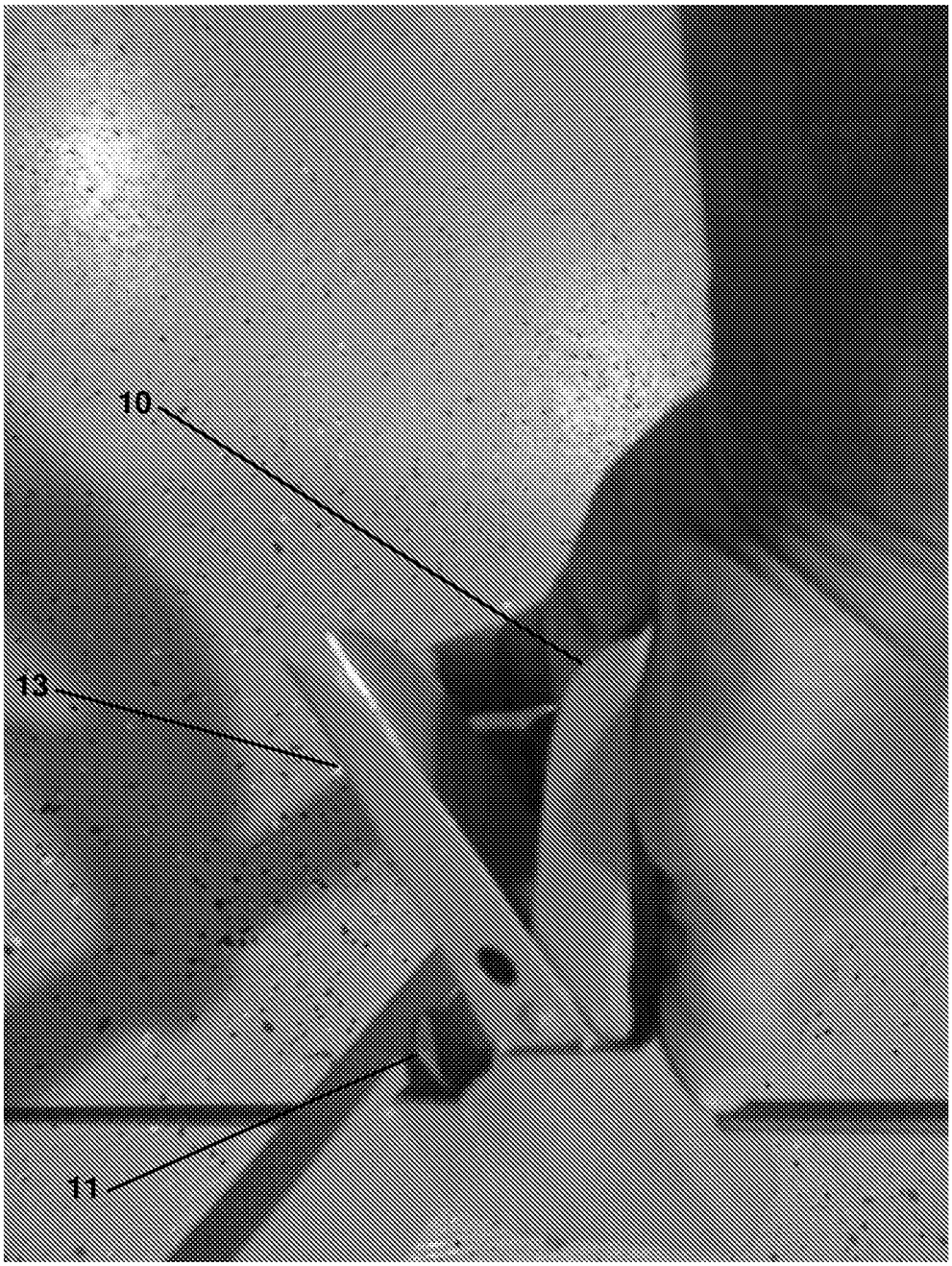
FIG. 12—Depicts an image of working prototype hand pull.
Figure 13:
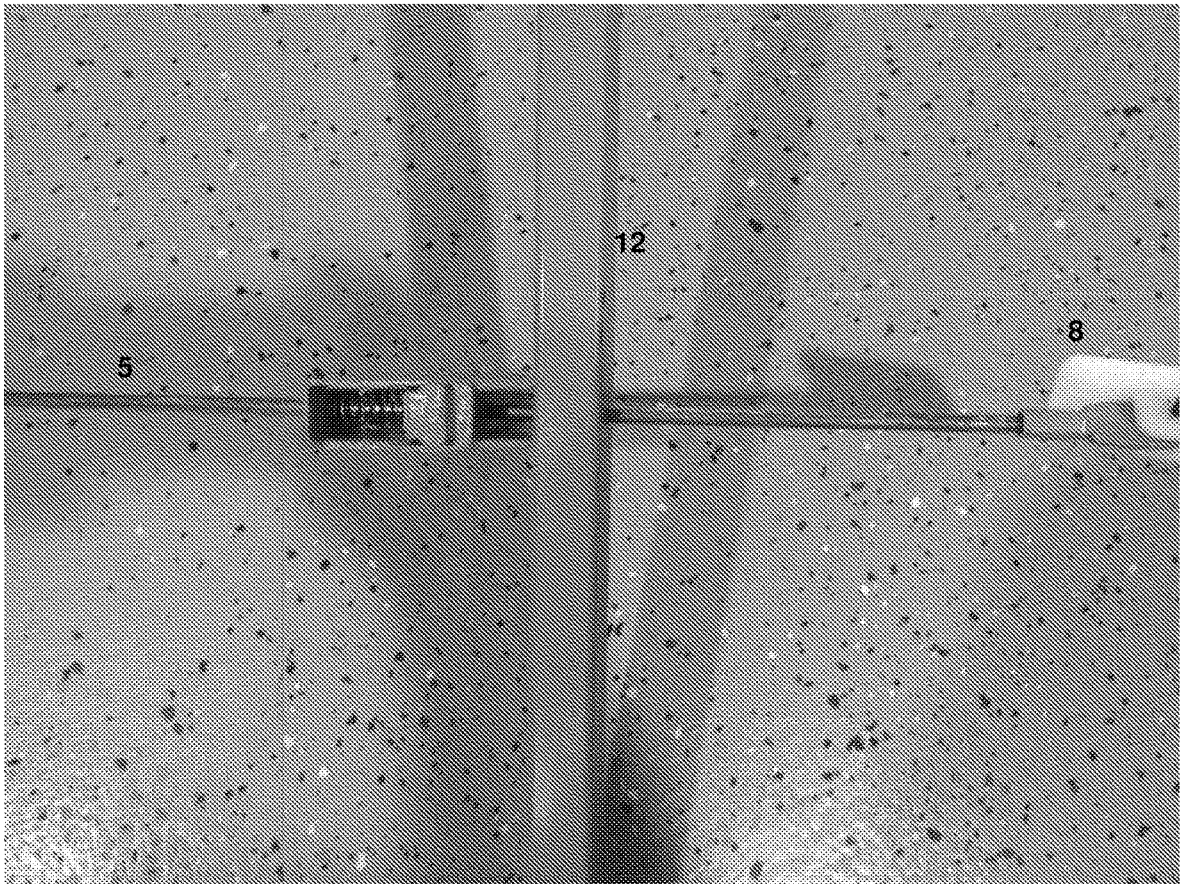
FIG. 13—Depicts an additional image of working prototype hand pull.
Figure 14:
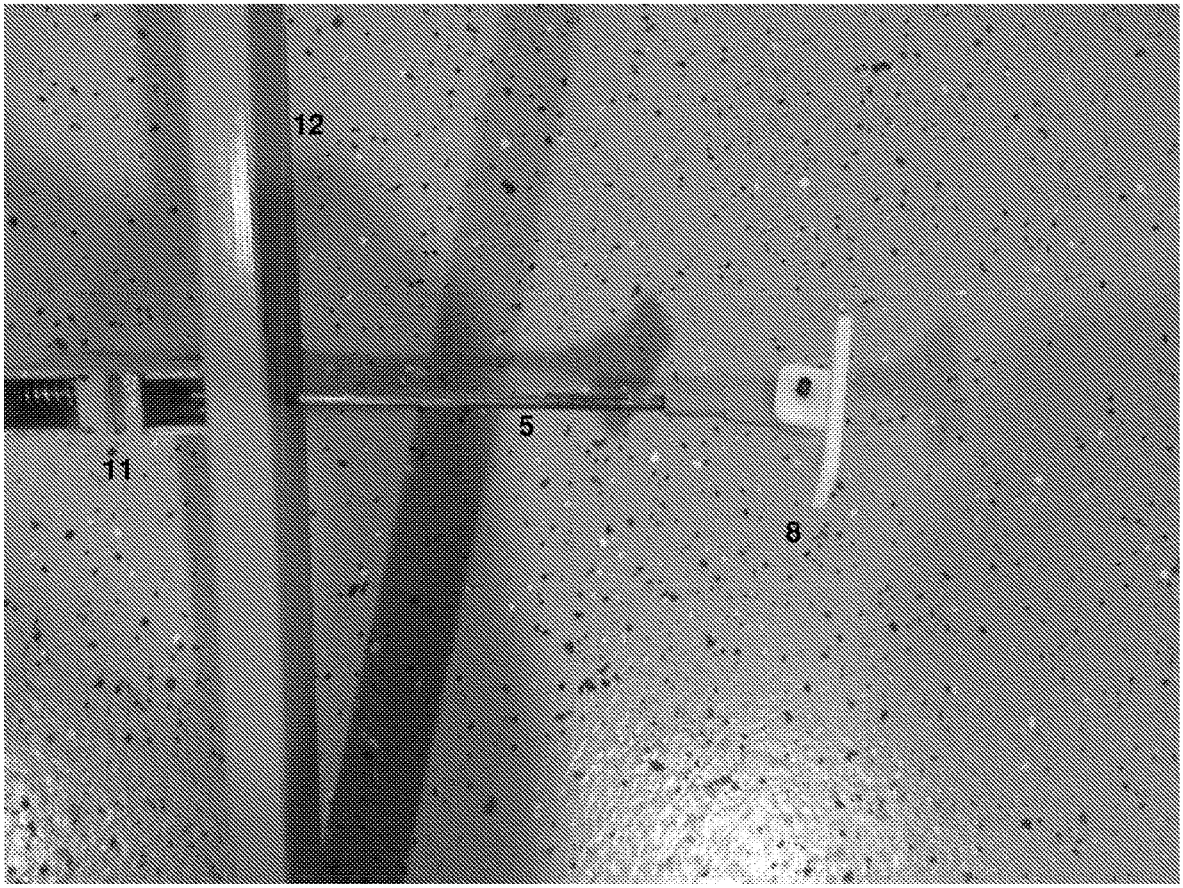
FIG. 14—Depicts the prototype of the sized support which attaches to the shaft end for various fixture types and drain sizes.

The device, FIG. 8, is placed on top of the substrate [2] as indicated in FIG. 2. with the stationary support [12] including attachment members which are suction cups. The stationary support is spanning the opening [1] in the substrate [2]. The device is secured via the suction cups [7], FIG. 4, to the substrate. The sized support [8], FIG. 1 & FIG. 14 which is installed on the bottom end of the shaft [5], FIG. 3, can then be inserted into the drain opening [6] of the fixture [3]. Once inserted, the sized support [8] FIG. 1, will swivel, making itself now large enough to fully engage and support the fixture [3]. Installer 1 may now perform the initial raise indicated in FIG. 5, by pulling upwards on the shaft rod [5] and pull [9]. The manual hand pull/tight device [10], FIG. 12, will automatically engage the shaft rod [5] and prevent the fixture from falling back down once pulled. Installer 1 may now adjust and assure proper alignment of the fixture [3] with the countertop hole [1]. Once assured, the final tight connection can be made via the hand pull [10] which is an actuation member being connected to a stationary handle [13] FIG. 12 & FIG. 13. Once the fixture [3] is secured to the substrate [2]. The release lever [11] on the hand pull can be trigged to release the rod [5] and sized support [8] back through the drain opening [6]. This will disengage the sized support [8] from the bottom of the fixture drain opening [6] and allow for swivel and retrieval of the sized support device [8] from the top of the fixture through the drain opening [6].

What is claimed is:

1. A universal undermount fixture installation device, for use by a single installer to raise and install undermount plumbing style fixtures from above the countertop, sais device comprising:

an elongated support including an attachment member, for spanning the countertop/substrate opening where the fixture will be installed; and a shaft rod which connects through the elongated support which is sitting on the countertop with the fixture inside the base cabinet below the opening in the countertop; and a pull attachment including a knob which connects to the top of the shaft rod to allow the installer a secure grip location when using the tool to raise the fixture the initial distance up to the counter before final alignment and tightening; and a sized support including a member having a connector inside apertures which connects to the bottom of the shaft rod and engages the fixture through the drain opening to allow for the fixture to be pulled up to the countertop from above and disengaged from above when work is complete; and a hand tight device including an stationary handle and an actuation member which connects the shaft rod to the elongated support and allows the fixture to raise the final incremental distance to be secured from above after checking alignment of the fixture to the countertop opening.

2. The device of claim 1 wherein the sized support is a secured to the shaft rod via a shear bolt or pin attachment allowing for rotation of the swivel device which is parallel with the shaft rod when entering the drain opening and them becoming perpendicular when through the opening to engage the load of the fixture for raising.

3. The device of claim 1 wherein the hand tight device is secured to the base via a welded connection.

4. The device of claim 1 wherein the attachment members are suction cups of the support base.

5. A method of using an universal undermount fixture installation device, for use by a single installer to raise and install undermount plumbing style fixtures from above the countertop, said method comprising steps of:

step of using an elongated support including an attachment member, for spanning the countertop opening where the fixture will be installed; and using a shaft rod which connects through the elongated support which is sitting on the countertop/substrate with the fixture inside the base cabinet below the opening in the countertop; and step of using a pull attachment including a knob which connects to the top of the shaft rod to allow the installer a secure grip location when using the tool to raise the fixture the initial distance up to the counter before final alignment and tightening; and using a sized support including a member having a connector inside apertures which connects to the bottom of the shaft rod and engages the fixture through the drain opening to allow for the fixture to be pulled up to the countertop from above and disengaged from above when work is complete; and step of using a hand tight device including an stationary handle and an actuation member which connects the shaft rod to the elongated support and allows the fixture to raise the final incremental distance to be secured from above after checking alignment of the fixture to the countertop opening.

6. The method of claim 1 wherein the step of the sized support being secured to the shaft rod via a shear bolt or pin attachment allowing for rotation of the swivel device which is parallel with the shaft rod when entering the drain opening and then becoming perpendicular when through the opening to engage the load of the fixture for raising the fixture into place.

7. The method of claim 1 wherein the step of welding the hand fighting to the base.

8. The method of claim 1 wherein the step wherein the support base and attachment members are suctions cups which secure to a substrate and prevent movement of the device when in use allowing for removal without damage to finish surfaces.

* * * * *